US005806815A

United States Patent [19]

Knutson

[11] Patent Number: 5,806,815

[45] Date of Patent: Sep. 15, 1998

[54] ADJUSTABLE BRACING STRUCTURE FOR YARD BAGS

[76] Inventor: Roger C. Knutson, 6444 Dover Rd., indianapolis, Ind. 46220

[21] Appl. No.: 658,225

[22] Filed: Jun. 4, 1996

[51] Int. Cl.[6] ..... B65B 67/12

[52] U.S. Cl. ..... 248/99; 248/97; 248/156

[58] Field of Search ..... 248/99, 100, 156, 248/297.51, 295.11, 545, 95, 159, 161, 97, 171, 163.1, 166, 169; 403/363, 393; 52/296, 165; 135/114

[56] References Cited

U.S. PATENT DOCUMENTS

| | | | |
|---|---|---|---|
| 2,851,823 | 9/1958 | Peterson | 258/156 X |
| 3,679,160 | 7/1972 | Ballenger | 248/97 |
| 3,744,081 | 7/1973 | Miller | 15/257.1 |
| 3,747,653 | 7/1973 | Ringer | 150/1 |
| 3,866,872 | 2/1975 | Burgess | 248/97 |
| 3,973,376 | 8/1976 | Suominen | 53/385 |
| 4,006,928 | 2/1977 | Beugin | 294/1 R |
| 4,069,993 | 1/1978 | Shanka | 248/97 |
| 4,174,085 | 11/1979 | Ferreira et al. | 248/97 |
| 4,269,441 | 5/1981 | Hirsch | 294/1 R |
| 4,561,480 | 12/1985 | Underwood et al. | 150/49 |
| 4,664,348 | 5/1987 | Corsaut, III et al. | 248/99 |
| 4,759,519 | 7/1988 | Cheng | 248/99 |
| 4,768,742 | 9/1988 | Kaaloa | 248/99 |
| 4,832,292 | 5/1989 | Beckham | 248/99 |
| 5,000,406 | 3/1991 | Petersen | 248/99 |
| 5,011,103 | 4/1991 | Hayes et al. | 248/99 |
| 5,067,683 | 11/1991 | Wager | 248/156 X |
| 5,107,666 | 4/1992 | Rahtican | 56/202 |
| 5,125,194 | 6/1992 | Granger | 403/363 X |
| 5,190,253 | 3/1993 | Sable | 248/97 |
| 5,564,660 | 10/1996 | Gyor | 248/97 |
| 5,597,145 | 1/1997 | Meyers et al. | 248/97 |

*Primary Examiner*—James R. Brittain
*Assistant Examiner*—Robert J. Sandy
*Attorney, Agent, or Firm*—Bruce J. Bowman

[57] ABSTRACT

A support structure, primarily for a trash or lawn bag is characterized by two identical bracing supports that are positioned to support the bag when staked into the ground. The bracing supports include a lower leg and an upper leg. Each leg is formed with a specific cross-sectional shape that allows the nesting and close coupling of the lower leg to the upper leg. An elbow or right angle member is releasably attached to the lower leg to fix the depth of the lower leg within the ground and trap the bag between the ground and the elbow member. Slidably received over the upper leg is a retainer clip having a right angle support and an opening having the same outer configuration as the cross-sectional shape of the legs such that the retainer clip may freely slide along the length of the upper leg member. Additionally, the clip includes an angled flange cooperating with the opening to provide mechanical retention of the clip against the leg when the height of the clip is set and the bag is held tight against the right angle support by bag tension.

10 Claims, 5 Drawing Sheets

ADJUSTABLE BRACING STRUCTURE FOR YARD BAGS

BACKGROUND OF THE INVENTION

1. Field of the Invention

The present invention relates to devices for facilitating the collection of debris and, more particularly, to devices for holding open lawn and trash bags during the debris collection process.

2. Description of the Prior Art

It has always been a struggle to maintain lawn and trash bags open during a debris collection process such as when collecting and discarding leaves, grass trimmings. This is due to the nature of the large plastic or other fabric type bags that are widely used for such debris or trash collection. These bags are flexible to the point that is it difficult to keep the mouth of the bag open in order to fill the bag with the debris. It is even more difficult if only one person is trying to do the collection process.

Because the collection of debris is generally performed in the above-noted manner, it is tiresome to accomplish many types of tasks. Therefore, the prior art is replete with various types of devices for holding open trash bags. Most of these devices are cumbersome to use or do not have much versatility to adapt them for use with various types of trash or garbage collection.

It is therefore evident from the above, that while the prior art is replete with trash bag holders and the like, none of them have simplified the ability to retain the opening of the bag against the ground while also adjustably maintaining the opening of the bag in an open position, regardless of the size of the bag.

In view of the above, it is an object of the present invention to provide a bag support that retains the opening of the bag against the ground while the size of the opening may be variably set and maintained.

It is another object of the present invention to provide a trash or lawn bag support structure as above that is strong, readily adjustable, and generally convenient to use.

It is yet another object of the present invention to provide a bag support as above that is readily adaptable to any size bag while providing the same level of support no matter what the bag size.

It is further an object of the present invention to provide a bag and support system as above that together provides the above-identified objects.

SUMMARY OF THE INVENTION

In keeping with the objects of the present invention, there is provided a bracing structure that is extremely adjustable in height and width to accommodate any size of bag.

The bracing structure is characterized by a pair of identical supports that form left and right holders. Each holder includes an identically configured upper and lower leg, an elbow, and an adjustable slide member.

The upper and lower legs are configured with a central, longitudinally oriented, raised web that, along with left and right side lips form a longitudinal essentially U-shaped trough. Each leg also has a series of bores along the web. The upper and lower legs thus complementarily fit into each other and are secured to one another by bolts and nuts that extend through the bores. In this manner, the overall height of the holder is limited only by the original length of the upper and lower legs. However, many leg sections may be coupled to one another to increase the overall height of the holder.

According to one aspect of the leg configuration, the cross-sectional shape of the legs provides exceptional torsional and longitudinal strength and rigidity, as well as allowing for the leg sections to be stacked on one another. Various materials are suitable for the leg section, however, an aluminum alloy is preferable because of its corrosion resistance and formability. The legs may be manufactured through extrusion.

The elbow is also a preferably aluminum alloy extruded part that is formed with the same cross-sectional shape as the leg sections. The elbow is a right angle piece that also includes bores to attach the elbow proximate to a lower end of one of the leg sections. The elbow is used to anchor the holder into the ground and hold the bag open, trapping the bag between the ground and the elbow. The depth of the rod that extends into the ground, and thus its stability, is determined by the location of the elbow relative to the ground end.

The bracing structure includes a self-locking slide to support the upper side of the bag opening and that permits incremental adjustment to finely accommodate the bag after the desired opening height and width have been set. The slide is a right angle member preferably formed of the same material as the legs and the elbow, and includes a hole structure in one side of the right angle member that has the same configuration or shape as the cross-sectional shape of the leg sections. In this manner, the slide is oriented therearound and adjustably movable along the leg. Additionally, the slide has an outwardly angled ear or flange that assists in releasably locking the slide against the leg. The angled flange permits the slide to rest on the leg in an offset position, thereby preventing the slide from falling down the leg due to gravity. In accordance with an aspect of the present invention, the slide uses bag tension and mechanical force against the leg section to affix or releasably lock the slide in place.

In operation, the various legs are coupled together to set a maximum height for the bag opening and defining a stake. The elbow member is also coupled to the stake. The supports are then set into the ground with a desired spacing to provide the width of the bag opening. The bag opening is placed under the elbow member and the stake is fully driven into the ground such that the elbow member traps the bag between itself and the ground.

At this point, the slides are placed around the stakes and set to the desired height. The angled flange prevents the slide from easily falling out of position. Preferably, the bag includes holes which fit over the top of the stake. The upper portion of the bag opening then rests upon the slide, wherein bag tension and mechanical force between the slide and stake maintain the height of the bag opening. It is then a matter of scooping the trash into the bag opening.

According to another aspect of the present invention, the trash bag may be specially designed for the present support structure and be a part of an environmental system that includes the bag and the supports. The bag may include holes to allow the upper and lower legs of the bracing structure to extend therethrough. Additionally, the bag would be made of a durable material such as plastic or polyolifin and would include a plurality of tiny perforations thereabout. Preferably, the perforations are circular in shape and permit air and water to easily penetrate the bag for easy composting within the bag itself. Once the contents of the bag are composted, the bag may be reused.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION OF THE PREFERRED EMBODIMENT

Figure 1:
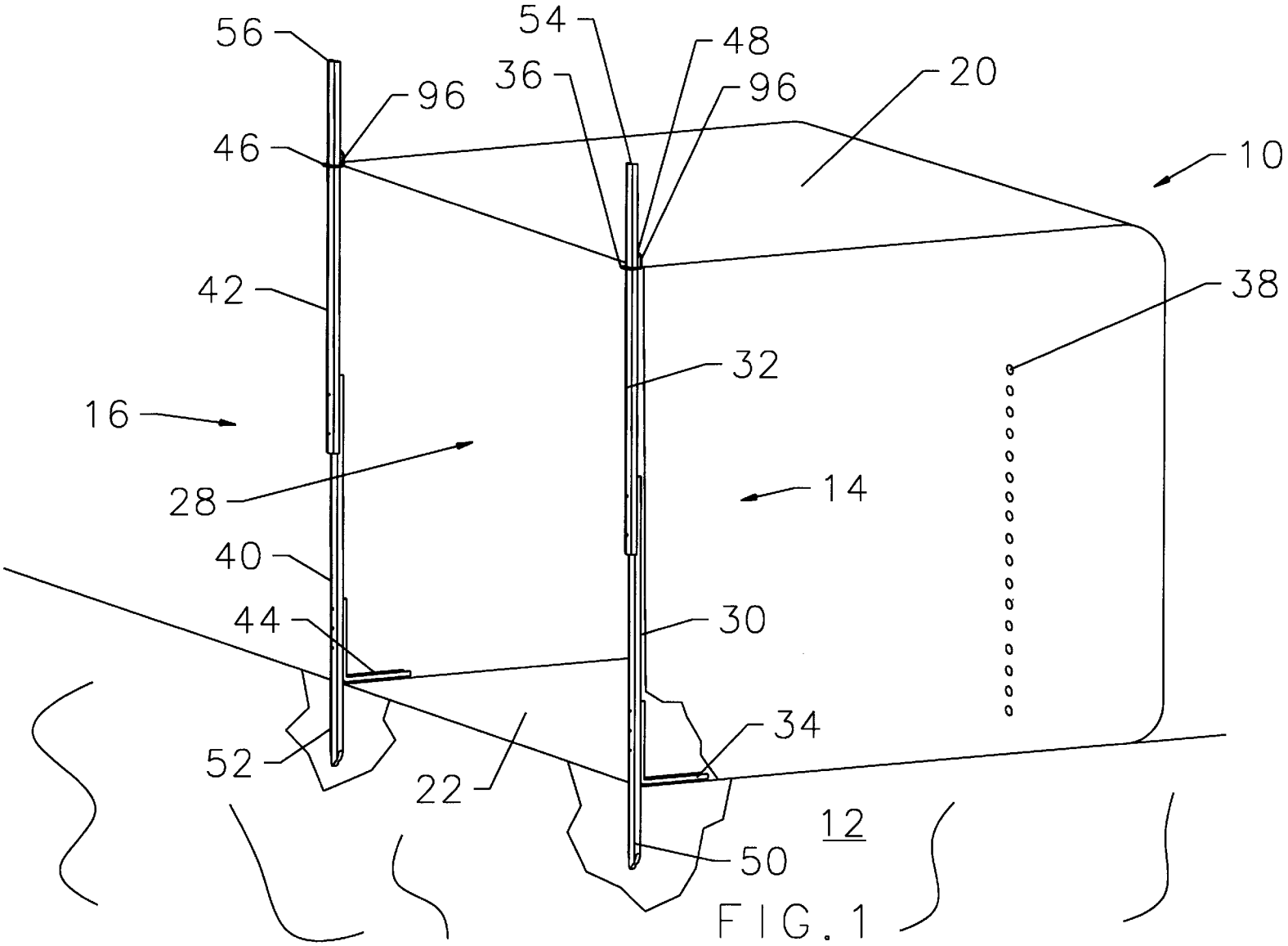
FIG. 1 is a perspective view of a lawn or trash bag held in an open position by right and left adjustable bracing structures according to the present invention, the bag retained with one side against the ground and the opening adjacent thereto.

Referring now to FIG. 1, there is shown a yard bag, generally designated 10, that is being retained in an open position by a right adjustable brace 14 and a left adjustable brace 16, together defining a support structure. The right and left braces 14, 16 hold the bag 10 such that a bottom side 22 of the bag 10 is against the ground 12 and the opening 28 of the bag is in its generally widest position. As will be understood, the size of the opening 28 is variable depending on the spatial location of the braces 14, 16 relative to each other and the height setting. Also, because of the extreme adjustability of the present invention, any size or type of bag may be used.

While any type of lawn or trash bag may be used in conjunction with the present support structure, in accordance with one aspect of the present invention, the bag 10 may include a plurality of perforations or holes 38 that would be disposed about the bag. The number of holes 38 is variable, but serve to promote the composting of any organic material therein. The holes 38 are preferably circular in shape, but can be of any shape and size while keeping the trash therein but allowing air and moisture to come in and out. Alternatively, and/or also, the bag 10 may include a pair or more of openings, of which only one such opening 48 is shown, to allow the supports to capture the bag.

The right support 14 includes a lower leg 30 adjustably and releasably attached to an upper leg 32 in a manner described hereinbelow. Adjustably and releasably attached to the lower leg 30 is a right angle or elbow member 34. The elbow member 34 is attached proximate the bottom 50 of the lower leg 30 depending on the insertion depth of the bottom 50 of the lower leg 30 into the ground 12 in a manner as described hereinbelow. Received about the upper leg 32 is a right retainer 36 that is slidable along the length of the upper leg 32. As described hereinbelow, the retainer 36 fixes the height of the bag 10 by supporting the upper side 20 of the bag 10 through bag tension. The top 54 of the upper leg 32 extends through the opening 48 in the bag 10 with the upper side 20 of the bag 10 resting on a right angle flange 96 of the retainer 36.

The left support 16 likewise includes a lower leg 40 adjustably and releasably attached to an upper leg 42 in the manner described hereinbelow. Adjustably and releasably attached to the lower leg 40 is a right angle or elbow member 44. The elbow member 44 is attached proximate the bottom 52 of the lower leg 40 depending on the insertion depth of the bottom 52 of the lower leg 40 into the ground 12 in the manner as described hereinbelow. Received about the upper leg 42 is a left retainer 46 that is slidable along the length of the upper leg 42. As described hereinbelow, the retainer 46 fixes the height of the bag 10 by supporting the upper side 20 of the bag 10 through bag tension. The top 56 of the upper leg 42 extends through another opening (not shown) in the bag 10 with the upper side 20 of the bag 10 resting on a right angle flange 96 of the retainer 46.

It should now be apparent that the right and left supports 14, 16 are identical. The detailed description of the various parts of the right and left braces 14, 16 referred to hereinbelow thus apply equally to both the right and left supports 14, 16. For convenience, the various parts will only be referred to once.

Figure 2:
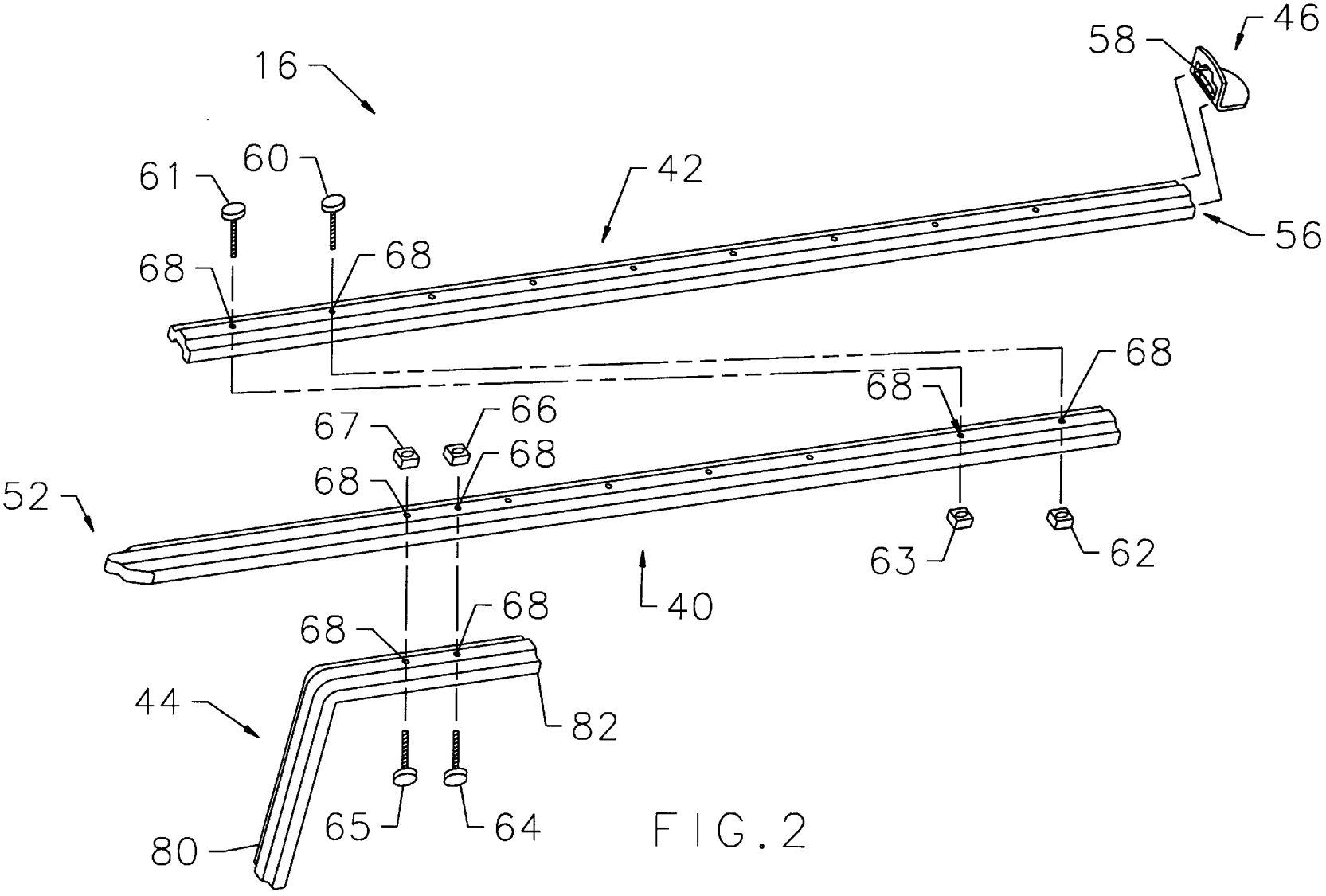
FIG. 2 is an enlarged exploded view of one of the adjustable bracing structures.
Figure 3:
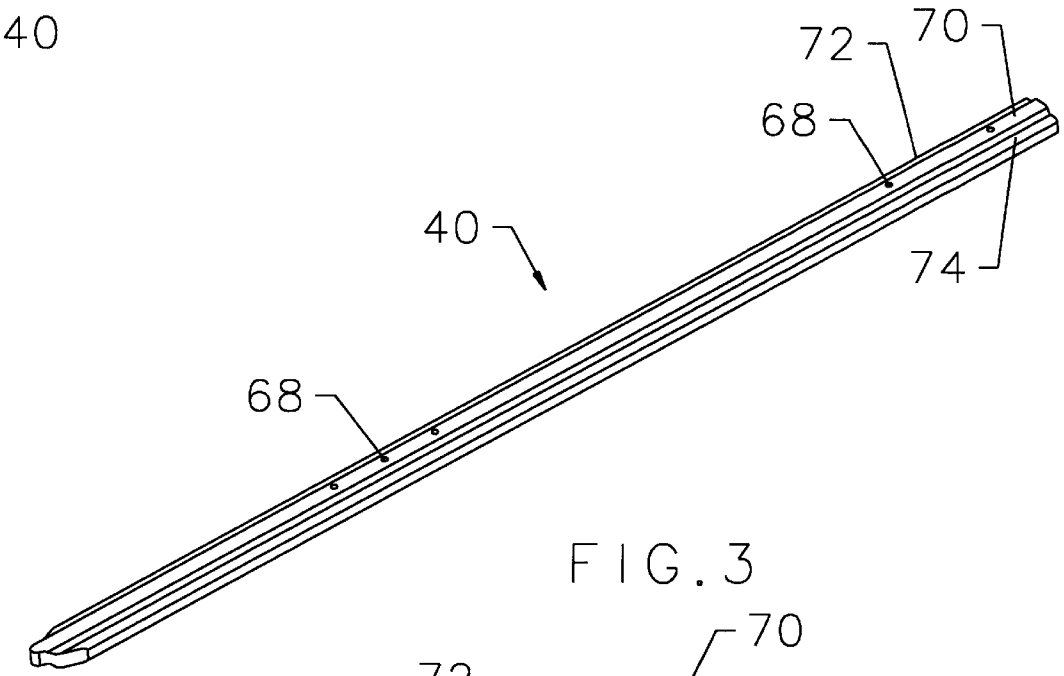
FIG. 3 is an enlarged perspective view of an upper or lower leg of the adjustable bracing structure.
Figure 5:
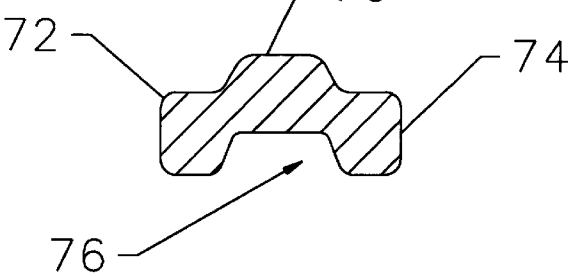
FIG. 5 is an enlarged sectional view taken along line 5—5 of FIG. 4.
Figure 4:
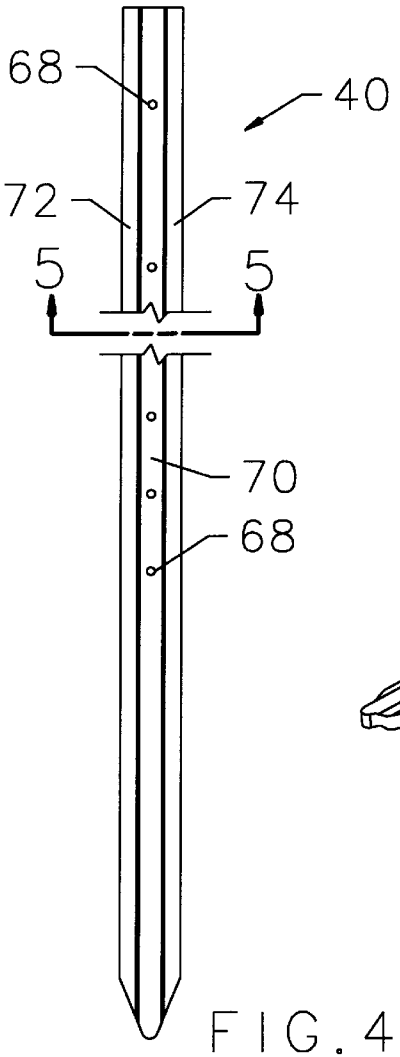
FIG. 4 is a top view of the leg of FIG. 3.

With particular reference to FIG. 2, there is shown the left support 16 being shown in an exploded view to more fully show its constituent parts. The left support 16 includes a lower leg 40 that is releasably coupled to an upper leg 42 of the same configuration. Coupling of the lower leg 40 to the upper leg 42 is accomplished by bolts 60, 61 extending through bores 68 disposed along the longitudinal length of the legs 40, 42. Nuts 62, 63 are threadedly received onto the bolts 60, 61 respectively. Because of the unique cross-sectional configuration of the legs 40, 42, the nuts 62, 63 are held against rotation when threadedly attached to the respective bolt 60, 61. Referring specifically to FIGS. 3–5, the leg 40 is depicted in greater detail.

The leg 40 is defined by a central, raised longitudinal web 70 that includes a series of bores 68 therethrough. On either side of the web 70 are longitudinal edges 72, 74 that together with the web 70 define a longitudinal channel 76 opposite to the web 70 and underneath thereof. The width of the channel 76 is sized to receive a nut and prevent its rotation. In this manner, the nut is "locked" against rotation. Thus, the corresponding bolt must turn or be threaded into the nut. Again, it should be understood that the upper and lower legs of both of the supports 14, 16 are identical, however, for simplicity and ease of understanding, only the lower leg 40 is described. It should also be understood that only one leg may be used or more than two legs may be used following the principles of the present invention. The cross-sectional shape of the leg 40 provides excellent torsional strength as well as allowing for the nesting of the legs when coupled together.

Figure 6:
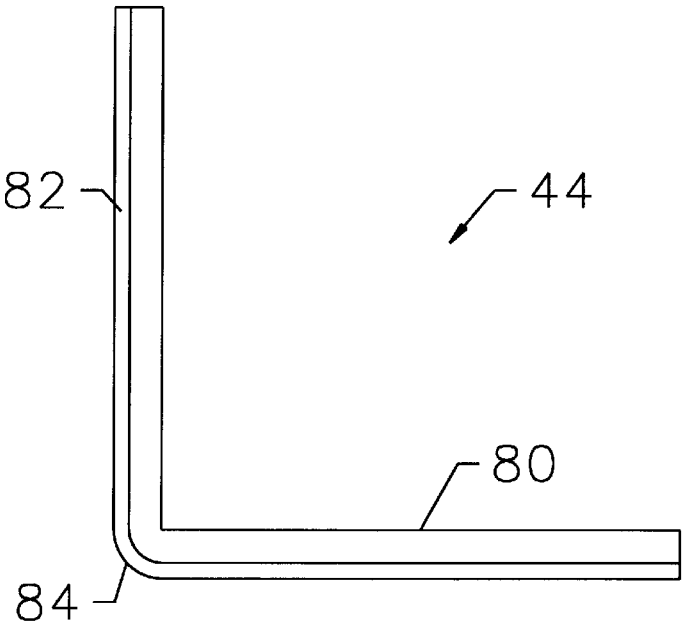
FIG. 6 is a side view of a left or right elbow retainer of the adjustable bracing structure.
Figure 8:
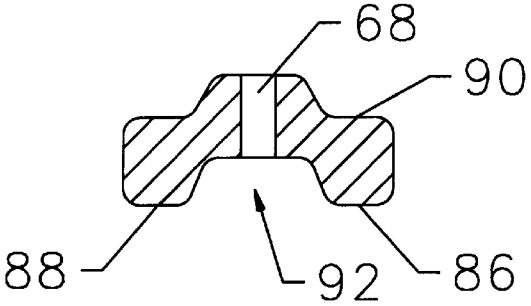
FIG. 8 is an enlarged cross-sectional view taken along line 8—8 of FIG. 7.
Figure 7:
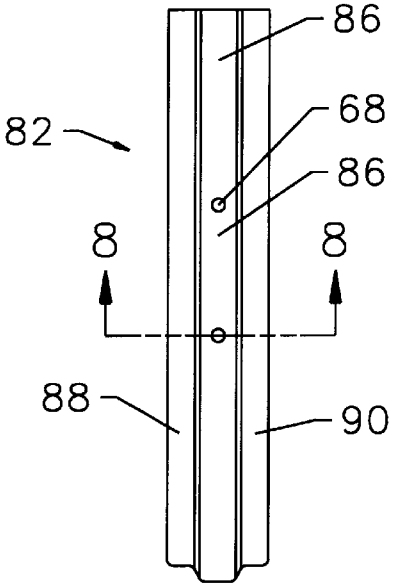
FIG. 7 is an enlarged, partial top view of the elbow of FIG. 6.
Figure 9:
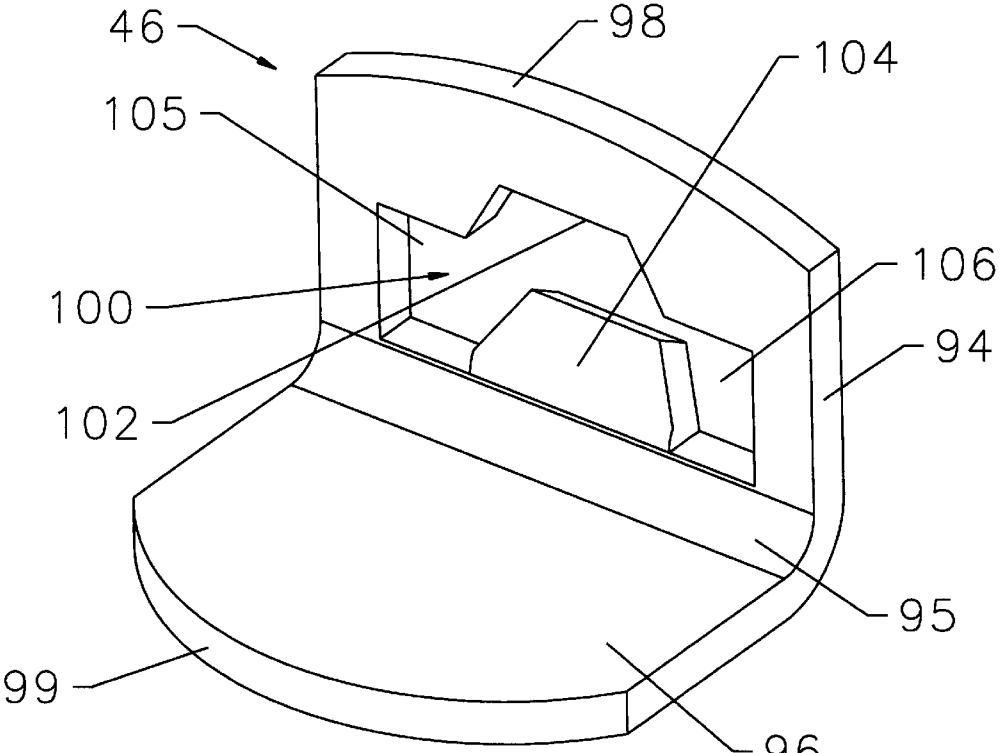
FIG. 9 is an enlarged perspective view of a slidable retainer according to the present invention.
Figure 11:
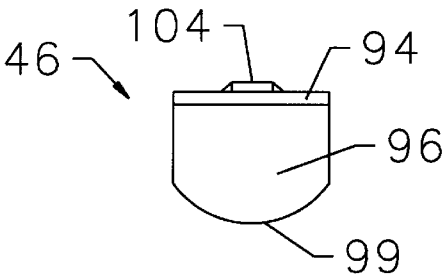
FIG. 11 is a top view of the slidable retainer of FIG. 9.
Figure 10:
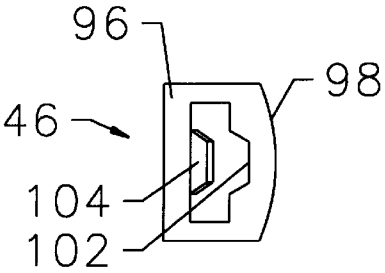
FIG. 10 a rear view of the slidable retainer of FIG. 9.
Figure 12:
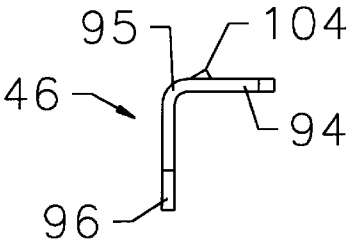
FIG. 12 is a side view of the slidable retainer of FIG. 9.

Referring back to FIG. 2, the lower leg 40 may include an angled end 52 for staking into the ground 12. Releasably coupled to the lower leg 40 is the elbow member 44 by bolts 64, 65 and respective nuts 66, 67 that extend through bores 68 in the elbow 44 and lower leg 40. With particular reference to FIGS. 6–8, the elbow member 44 is shown in greater detail. The elbow member 44 has a first leg 80 and a second leg 82 that includes a bend 84 thereby forming a right angle with respect to each other. The elbow member 44 has a cross-sectional shape that is the same as the cross-sectional shape of the legs 40, 42. Thus, the elbow member 44 nests with the leg into which it is coupled. The elbow member 44 may be attached to the lower leg 40 at any location along the leg, but generally proximate the end 52. The location of the elbow member 44 defines how much of the end 52 penetrates and is held by the ground 12. A sufficient amount of the leg 40 should extend into the ground to provide the requisite amount of stability.

As shown in FIG. 2, the retainer 46 has an opening 58 that receives the upper leg 42 and thus fits over the leg 42. Referring specifically to FIGS. 9–12, the retainer 46 is shown. Again, it should be understood that the retainer 46 is identical to the retainer 48 in all respects and thus the discussion regarding retainer 46 is applicable to the retainer 48. The retainer 46 is formed of a metal piece that is divided by a bend 95 into a first flange 94 and a second flange 96. The flanges 94, 96 essentially form a right angle. Each flange 94, 96 have an arcuate end 98, 99 respectively. Disposed in the flange 94 is an opening 100 that has the same profile or shape as the legs of the present invention, but is somewhat larger in order to be received about the upper leg. The opening is defined by a top portion 102 corresponding to the web 70 of the leg 40, left and right edges or ends 105, 106 that correspond to left and right ends 72, 74 of the leg 40, and an ear or projection 104 that corresponds to the channel 76 of the leg 40. In this manner, the opening 100 is keyed or oriented to the leg. The slide is positioned onto the leg with the flange 96 in the upward position in order to provide a support surface for the upper part of the opening of the bag 10.

According to an aspect of the present invention, the ear or projection 104 is angled or bent slightly outward. The ear 104 thus engages the channel 76 of the leg 40. Once the height of the slide 46 on the leg 40 is set, the slide will be angled slightly downward as the ear 104 rests within the channel 76.

In operation, and referring to FIGS. 1 and 2, the desired number of legs are bolted together to define a maximum height for each stake. An elbow is then bolted to the leg of each stake proximate the bottom to define a depth for ground penetration. The two stakes or supports are then set into the ground at a desired width to accommodate the opening of the bag being used. The bottom side of the bag opening is placed under the elbow to trap the bag between the elbow and the ground. The stakes are set by stepping on the elbows. Optionally, the stakes may be driven through a hole in the perimeter of the bag. The slides are then positioned on the respective stakes to set the vertical height of the bag opening. The upper portion of the bag opening is placed over the top of the stakes and caused to rest upon the slides.

It should also be understood that the present support may prop or hold other objects such as signs or the like. The present adjustable bracing or supporting structure may accommodate the propping of many articles or objects.

While the foregoing is directed to the preferred embodiment of the present invention, other and further embodiments of the invention may be devised without departing from the basic scope thereof, and the scope thereof is determined by the claims which follow.

What is claimed is:

1. A support structure for retaining a bag in an open position, the support structure comprising:

a pair of identical elongated members, each said elongated member having a front face and a rear face defined as opposite sides of a longitudinal cross-section thereof, said front face having an outer surface configuration defined by a first surface coupled to right and left lands by outwardly angled walls, said rear face having an outer surface configuration complementary to said outer surface of said front face whereby said elongated members are contiguously nestable;

a transverse arm disposed proximate one end of each said elongated member, said transverse arm having the same configuration as said elongated member; and a pair of identical retainers one for each said elongated member, each said retainer characterized by a cutout portion having a peripheral configuration corresponding to the outer configuration of said elongate members and adapted to be received thereon, whereby said retainers are adjustably retained on said elongate members by mechanical tension.

2. The support structure of claim 1, wherein each said elongate member has a plurality of bores therethrough, and each said transverse arm has a plurality of bores therethrough, whereby said transverse arms are adjustably attachable to said elongate members for setting a maximum insertion depth for said elongate members.

3. The support structure of claim 1, wherein each said retainer has a first flange having an arcuate end, and a second flange having an arcuate end, either said first or second flange having said cutout therein.

4. A support for holding a bag into an open position, the support comprising:

a first brace; and a second brace identical to said first brace;

said first brace having a lower longitudinal leg of a specific cross-sectional shape, an upper longitudinal leg of a specific cross-sectional shape the same as said specific cross-sectional shape of said lower leg releasably couplable to said lower leg, said cross-sectional shapes adapted to allow the nesting of said lower and upper legs upon coupling, an elbow member releasably couplable to said lower leg and having a cross-sectional shape the same as said specific cross-sectional shape of said lower leg to allow nesting of said elbow member with said lower leg upon coupling, and a slide having a first flange and a second flange disposed transverse to said first flange, said first flange having a cutout portion with a configuration corresponding to said specific cross-sectional shape of said lower leg but of a size adapted to fit on said upper leg, said slide adjustably positionable along the vertical length of said upper leg and releasably setable therealong via mechanical tension.

5. The support of claim 4, wherein said specific cross-sectional shape includes a raised web having a right lowered edge and a left lowered edge, said web and said edges together defining a channel disposed diametrically opposite said web and parallel thereto.

6. The support of claim 4, wherein said slide has an ear outwardly projecting from said cutout portion.

7. The support of claim 4, wherein said upper and lower legs, said elbow member, and said slide are all fabricated from an aluminum alloy.

8. The support of claim 4, wherein said second flange defines a support surface on which an object may rest.

9. A support structure for retaining a bag in an open position and against the ground, the support structure comprising:

a pair of identical supports;

each support having an upper leg and a lower leg adjustably coupled to one another, an angle bracket adjustably coupled proximate an end of said lower leg distal said upper leg, and a freely adjustable slide disposed about said upper leg;

each said leg having a cross-sectional shape defining a raised web, a left and right side, and a channel disposed diametrically opposite said web;

said slide having a first flange transversely coupled to a second flange, said first flange having a cutout portion having an outer configuration corresponding to said cross-sectional shape and sized to be received about said upper leg, said slide further having an ear outwardly projecting from said cutout portion at the correspondence point to said channel whereby said slide is adjustably fixable on said upper leg via mechanical tension; and said angle bracket adapted to trap a side of an opening portion of the bag between itself and the ground, said slide supporting another side of the opening portion of said bag via tension.

10. The support of claim 9, wherein said upper and lower legs, said angle bracket, and said slide are all fabricated from an aluminum alloy.

* * * * *